United States Patent [19]

Hubbell

[11] 3,962,899

[45] June 15, 1976

[54] METHOD AND APPARATUS FOR MAKING AN ECCENTRIC LOCKING COLLAR

[75] Inventor: Henry Hubbell, Southington, Conn.

[73] Assignee: Textron, Inc., Providence, R.I.

[22] Filed: Mar. 26, 1975

[21] Appl. No.: 562,007

[52] U.S. Cl. ..... 72/334; 72/344; 72/354

[51] Int. Cl.[2] ..... B21J 13/02

[58] Field of Search ..... 72/267, 334, 344, 354; 308/236

[56] References Cited

UNITED STATES PATENTS

| | | | |
|---|---|---|---|
| 2,057,669 | 10/1936 | Brauchler | 72/354 |
| 2,226,524 | 12/1940 | Runge et al. | 308/236 |
| 2,328,098 | 8/1943 | Remington et al. | 72/267 |
| 3,429,172 | 2/1969 | Lierse et al. | 72/344 |

*Primary Examiner*—Lowell A. Larson

*Attorney, Agent, or Firm*—Hopgood, Calimafde, Kalil, Blaustein & Lieberman

[57] ABSTRACT

The invention contemplates low-cost and improved manufacture of an eccentric locking collar, as for use in securing a bearing ring or the like to a shaft. The locking collar is made by cold-forming a cylindrical metal blank with an eccentric cylindrical recess at one end and with a concentric cylindrical recess at the other end. A coining tool having the desired locking surface profile is inserted into the eccentric bore and is driven in axial compression causing blank material to flow or extrude around the profile. Thereafter, a punching operation completes definition of the concentric cylindrical bore which is ultimately to accommodate assembly to a shaft, and finishing steps are performed, such as set-screw adapting and tumbling.

18 Claims, 7 Drawing Figures

METHOD AND APPARATUS FOR MAKING AN ECCENTRIC LOCKING COLLAR

The invention relates to low-cost manufacture of an eccentric locking collar, as for use in securing a bearing ring or the like to a shaft.

Conventionally, a locking collar of the character indicated is made from solid machine-steel bar stock, which undergoes a plurality of lathe-type machining operations to develop its desired profiling. Such operations, and the quality of the steel required for machining, are chiefly responsible for relatively high cost of manufacture.

It is an object of the invention to provide a method and means of substantially reduced cost for manufacturing a locking collar of the character indicated, without impairing locking effectiveness.

Another object is to meet the above object with a method which produces a product of improved locking capability.

A specific object is to meet the above objects with a method which may utilize lower cost input material.

A further specific object is to eliminate, or reduce to a minimum, machining operations in the manufacture of a locking collar of the character indicated.

Other objects and various further features of novelty and invention will be pointed out or will occur to those skilled in the art from a reading of the following specification, in conjunction with the accompanying drawings. In said drawings, which show, for illustrative purposes only, a preferred method and means of the invention:

Figure 1:
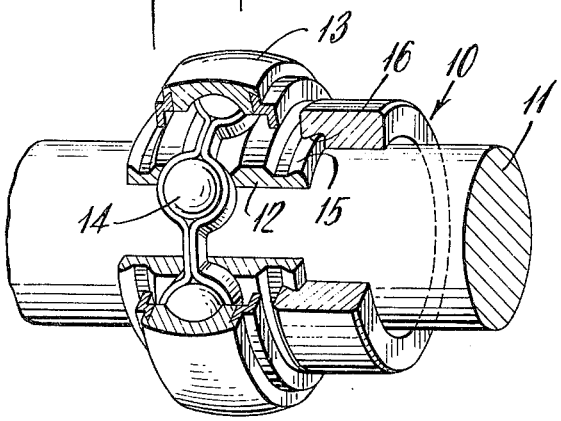
FIG. 1 is a perspective view of an antifriction bearing mounted to a shaft using a locking collar produced in accordance with the invention, parts being broken-away and shown in section to reveal certain details.

FIG. 1 illustrates a locking collar 10, produced by the invention, in its ultimate environment of securing an antifriction bearing to a shaft 11. The bearing is shown to comprise inner and outer race rings 12–13, with interposed spaced balls 14. The inner ring 12 is of the "wide" type, with an eccentric locking surface 15 generated around its periphery at one axial end, and the locking collar has an eccentrically relieved surface 16 to coact with ring surface 15 in developing a lock to shaft 11, upon relative rotation of surfaces 15–16.

Figure 2:
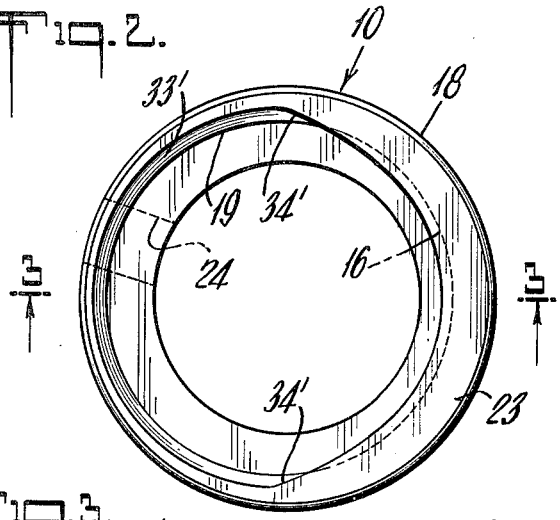
FIG. 2 is an axial-end view of the locking collar of FIG. 1.
Figure 3:
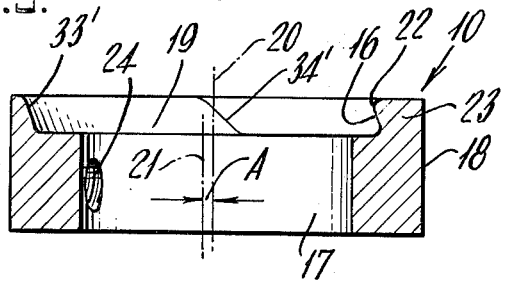
FIG. 3 is a sectional view, taken at 3—3 in FIG. 2.

FIGS. 2 and 3 show greater detail of the collar formation. Essentially, collar 10 has cylindrical inner and outer surfaces 17–18, and the relieved surface 16 is part of an eccentric counterbore 19 at one end. The extent of eccentric offset is designated A, from the central axis 20 to the eccentric axis 21. The relieved locking surface 16 is generally conical beneath the limited arc of a radially inward lip formation 22, the latter being generally confined to the radially thicker part 23 of the relieved end of ring 10. To complete the structure of collar 10, a threaded radial passage 24 accommodates a set screw (not shown).

In accordance with the invention, the essential collar contours including the "undercut" eccentric locking surface 16 are solely the result of cold-forming operations, as upon a solid cylindrical blank 25 of plain carbon steel, of the desired ultimate outside diameter. The progressive steps of these operations are illustrated in FIGS. 4 to 7.

Figure 4:
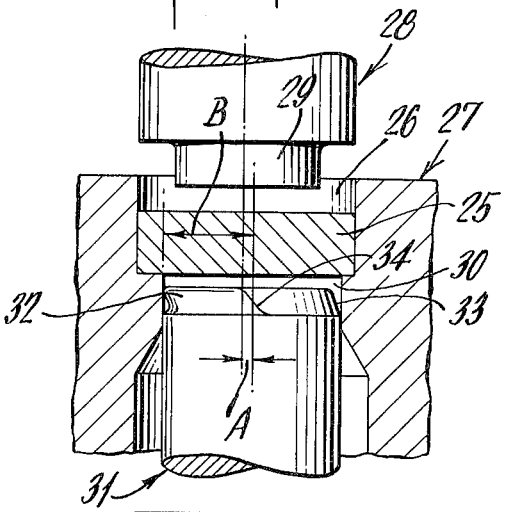

FIG. 4 shows blank 25 in readiness for a first such operation, the blank being seated at the shoulder of a counterbore 26 in a suitable die body 27. An upper punch element or anvil 28 has a cylindrical body to pilot on counterbore 26 and is additionally characterized by a projecting cylindrical punch formation 29, coaxial with element 28 and preferably sized to the ultimate bore diameter of the inner surface 17 of the locking ring to be produced. Beneath counterbore 26, and therefore beneath blank 25, an eccentric cylindrical bore 30 extends downwardly, to pilot the upward displacement of the cylindrical body of a coining-die element 31. The eccentric offset A characterizes the axis relation of counterbore 26 with respect to bore 30, as indicated by legend in FIG. 4. And the upper end of element 31 has a coining-punch contour comprising an arcuate relief-characterizing formation 32, suited for ultimate definition of relief 16, lip 22 and all other features of the eccentric counterbore of collar 10, the undercut-forming side of formation 32 being angularly positioned for least radial offset from the central axis of the die counterbore 26 and therefore of blank 25. The formation 32 may be generated as a turned circular arc of radius B about the axis of punch element 31, and lip 22 may be developed over at least no more than substantially semi-circular extent, as by grinding an arcuate bevel 33 having opposed tangentially faired connections 34 to the arcuate formation 32.

Figure 5:
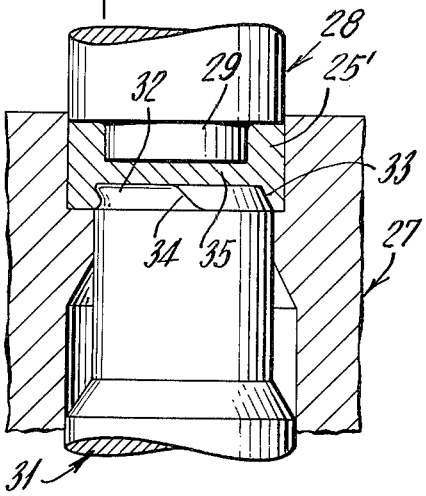
Figure 6:
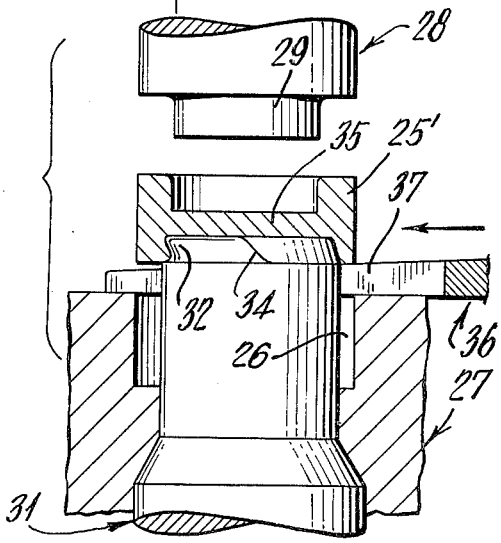

Having established the indicated bore and punch relationships of FIG. 4, the punch elements 28–31 are compressed against each other to perform plastic-deforming displacement work upon the blank 25, to the extent indicated in FIG. 5, wherein the deformed blank is designated 25'. In this relationship, it will be understood that upward displacement of the coining element 31 has been limited by means (not shown) such that the coining formations 32–33–34 are wholly within counterbore 26 and such that the guided cylindrical body of element 31 is wholly within and beneath the pilot bore 30. At the same time, the upper punch element 28 retains a piloted relation to bore 26, and its formation 29 is fully immersed in the worked blank 25'. Blank 25' is thus characterized by a relatively thin wall portion or web 35 between a major axial fraction of the ultimate concentric bore surface 17, and by the full contour definition of the eccentric relief 16 and lip 22. In addition, the eccentric counterbore 19 will have been further characterized by an arcuate bevel 33' with tangentially faired connections 34' to lip 22, corresponding to the relation already described at 32–33–34' the slope of bevels 33–33' will be understood to be such as to provide draft clearance, for removal of blank 25' from punch element 31. Having thus defined significant contours in the blank 25', it is removed for its final operation, namely, to complete the concentric bore surface 17; FIG. 6 illustrates the step of removing the worked blank 25' from the coining tool 31. First, the upper punch element 28 is fully retracted to allow ample vertical clearance above the blank 25' when displaced out of bore 26 and above the upper surface of the die body 27. A forked tool 36 is then radially inserted into the vertical clearance between the lower edge of blank 25' and the upper surface of die body 27; preferably, the upper surface of the thus-inserted tyne part 37 of tool 36 is sloped as shown, so that upon subsequent retracting displacement of punch element 31, the beveled side of blank 25' develops first interference with tool 36, to cause slight counterclockwise tilt of blank 25' and therefore simpler withdrawal of the coining formation from the "undercut" 16 of the blank 25'. Once it is clear of all tools, blanks 25' may be handled and transferred (by means not shown) to a separate punchout station, illustrated in FIG. 7.

Figure 7:
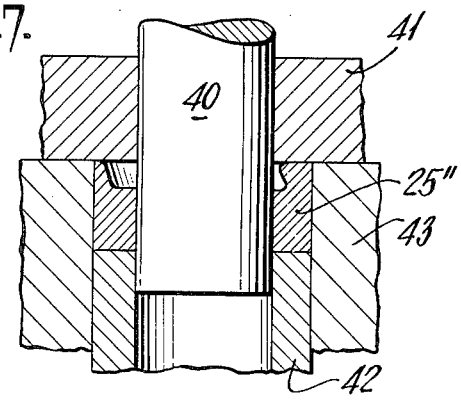
FIGS. 4 to 7 are simplified vertical sectional views of tooling and a workpiece, for successive operational steps in carrying out the invention.

In FIG. 7, cylindrical punch element 40 is shown guided by an upper die body 41 for concentric alignment and register with the cylindrical bore of the blank 25', the latter having been upon a sleeve 42 in the guide bore of a lower die body 43; inner and outer diameters for sleeve 42 will be understood to be essentially those of surfaces 17–18 of the locking collar 10. Descent of the punch element 40 is shown to have removed the web 35 and to have completed the full axial extent of the locking-ring bore 17, so that the resulting blank 25'' has all the principal characterizing features of the ultimate locking collar 10. Blank 25'' is ejected by upward displacement of sleeve 42 after retracting the upper die body 41 and its punch 40, with respect to die body 43 and blank 25''.

It will be understood that the profile of punch 31, at 32, need not be precisely the generated result of turning about the axis of punch 31. The particular desired profile offset and its simple (e.g., circular, turned) or complex (e.g., elliptical, or profile-milled) nature will depend inter alia (a) upon shaft-mounting tolerances for the bearing ring 12 to shaft 11 and for the collar 10 to shaft 11 and (b) upon the range of convergence angles to be tolerated at locking contact between surfaces 15–16. Also, it will be understood that at the respective arcuate limits of the profile 32, the strictly turned or otherwise simply generated nature of profile 32 may include such filler or other body formations (e.g., tangential, at 34) in the punch element 31 as will assure "angled" termination of the lip 22, to merge with the axial end of the eccentric bore 19 at substantially diametrically opposed locations; such "angled" terminations of lip 22, at 34's in FIG. 2, in conjunction with the bevel 33, provide draft clearance for the described retraction of tool 31.

The foregoing description has been concerned primarily with the formation of the operative profiles of the locking collar 10. It will be understood that later steps to the completed article may include formation of set-screw passage 24, as by drilling and tapping, and then tumbling for smoothing of edges. Also, blackening or other conventional finish may be applied, as desired.

The described method and apparatus will be seen to have achieved all stated objects. A locking collar can be cold-formed without turning operations, and yet exhibit the desirable non-slip-off feature of a collar having a turned undercut. The formed collar uses cheaper steel and less of it, while exhibiting the superior properties achieved through work-hardening; plain carbon steel, work-hardened by cold-forming, is stronger and has more ductility than the free-machining steel customarily used in locking-collar manufacture. Cold-forming and later tumbling enable shaping for smoothly rounded optimally shaped contours, and if desired the collar need not be of such uniform wall thickness, being thicker only where needed for strength, for set-screw support, or the like.

While the invention has been described in detail for a preferred form and method, it will be understood that modification may be made without departing from the invention. For example, the "undercut"-producing formation 32 may be viewed as an arcuate eccentric projection integral with the body of element 31, and the section of element 31 may be other than circular.

What is claimed is:

1. The method of making an eccentric locking collar for locking a bearing ring or the like to a shaft, which comprises die-forming a blank of coinable metal into a cylindrical body having a central radial wall between opposed axially recessed and outwardly open end bores one of which is characterized generally cylindrical and eccentric and the other of which is concentric to the cylinder, thereby defining projecting body annuli at the ends of the blank, the eccentric-bore formation involving insertion of a die element into the blank, said die element being selected for a blank-working profile characterized by a radially outward arcuate projection fully contained within the blank-insertion region and said projection being angularly oriented for minimal radial offset from the concentric-bore axis, so that the body annulus of the eccentric bore is the result of coining into local conformity with said profile, and punching out of the central radial wall a cylindrical bore concentric with the body-cylinder axis and of radius to clear the coined eccentric bore.

2. The method of claim 1, in which the coinable metal is plain carbon steel.

3. The method of claim 1, in which the eccentric end bore is of larger diameter than that of the concentric end bore.

4. The method of claim 1, in which the punch-out radius of the last step is substantially the radius of the concentric end bore.

5. The method of making an eccentric locking collar for locking a bearing ring or the like to a shaft, which comprises die-forming a blank of coinable metal into a cylindrical body having a central radial wall between opposed axially recessed and outwardly open cylindrical end bores one which is eccentrically relieved and the other of which is concentric to the cylinder, thereby defining projecting body annuli at the ends of the blank, the eccentric-bore formation involving insertion of a die element axially into the blank, said die element being selected for a blank-working profile characterized by a radially outwardly projecting arcuate undercut-forming eccentric surface within the blank-insertion region, the arcuate surface of the die element being so angularly oriented that said arcuate surface is at lesser radial extent with respect to the axis of the concentric bore than is the remainder of the blank-insertion region of said die element, so that the projecting body annulus of the eccentric bore is the result of coining into local conformity with the eccentric portion of said profile, and punching out of the central radial wall a cylindrical bore concentric with the body-cylinder axis and of radius to clear the coined eccentric bore.

6. The method of claim 5, in which the axis offset for each of the two eccentricities is substantially the same.

7. The method of making an eccentric locking collar for locking a bearing ring or the like to a shaft, which comprises die-forming a blank of coinable metal into a cylindrical body having a central radial wall between opposed axially recessed and outwardly open cylindrical end bores one of which is eccentrically relieved and the other of which is concentric to the cylinder, thereby defining projecting body annuli at the ends of the blank, the eccentric-bore formation involving insertion of a die element axially into the blank, said die element being selected for a blank-working profile characterized by a radially outwardly projecting arcuate undercut-forming eccentric surface defining an open arcuate eccentric groove within the bore-insertion region, the arcuate eccentric groove of the die element being so angularly oriented that said arcuate surface is at lesser radial extent with respect to the axis of the concentric bore than is the remainder of the blank-insertion region of the die element, so that the projecting body annulus of the eccentric bore is the result of coining into local conformity with the eccentric portion of said profile, and punching out of the central radial wall a cylindrical bore concentric with the body-cylinder axis and of radius to clear the coined eccentric bore.

8. The method of claim 7, in which the body of the die element is cylindrical and the projecting arcuate surface is within the geometric axial projection of the cylindrical body.

9. The method of claim 8, in which the limited arcuate extent of the arcuate surface and groove are approximately one half the periphery of the die element.

10. The method of claim 7, in which the groove has a generally conical surface sloped with increasing radius in the axial direction of the insertion end of the die element.

11. The method of claim 7, in which the maximum depth of the groove is of substantially the same extent as the eccentric offset of the two bores.

12. The method of claim 11, in which the groove is arcuate about the cylindrical axis of the body of the die.

13. Tool structure for use in forming an "undercut" eccentric-locking surface in a coinable workpiece of cylindrical external shape and having an eccentric bore at one axial end, said structure comprising a work-supporting body having a first bore of diameter to coaxially support the work-piece and having a communicating guide bore eccentric to the first bore, anvil means within said first bore to support the workpiece at its other axial end, the eccentric work bore being contained within the body bore, and die means including a coining-punch element reciprocably guided by the eccentric guide bore, said punch element having a radially outwardly projecting "undercut"-characterizing formation of limited arcuate extent and enterable into the workpiece, when the workpiece is axially compressed between said die means and said anvil means.

14. Tool structure according to claim 13, in which the characterized arcuate projecting formation terminates at substantially diametrically opposed locations, thereby providing draft clearance for transverse displacement of the workpiece with respect to the first-bore axis upon die-projected displacement of the workpiece out of the first bore.

15. Tool structure according to claim 14, in which said terminations are essentially tangential to the arc of said characterized arcuate projecting formation.

16. An "undercut"-forming tool, comprising a cylindrical body, one end of which is characterized by a first limited arcuate projection within the geometrical projection of the cylinder of said body, said projection being spaced from the cylindrical body by a correspondingly arcuate groove, said end being further characterized by a bevel of arcuate extent generally diametrically opposite to said projection and of axial extent approximately the combined axial extent of the groove and projection.

17. The tool of claim 16, in which said arcuate extents are generally equal.

18. The tool of claim 16, in which the groove has a generally conical contour of slope approximating that of said bevel, thereby affording draft clearance for tool removal from a workpiece.

* * * * *